US005829462A

United States Patent [19]

Cho

[11] Patent Number: 5,829,462

[45] Date of Patent: Nov. 3, 1998

[54] UMBRELLA FRAME CAPABLE OF AUTOMATIC FOLDING AND UNFOLDING

[76] Inventor: Chia Yi Cho, 266 Chan Ma Street Ma Hsin Villiage, Show Swei Hsiang, Chan Hua Hsien, Taiwan

[21] Appl. No.: 958,062

[22] Filed: Oct. 27, 1997

[51] Int. Cl.[6] ..... A45B 25/14

[52] U.S. Cl. ..... 135/22; 135/28

[58] Field of Search ..... 135/22–24, 19, 135/28, 33.6, 15.1

[56] References Cited

U.S. PATENT DOCUMENTS

| | | | |
|---|---|---|---|
| 680,661 | 8/1901 | Hunt | 135/24 |
| 4,941,494 | 7/1990 | Wu | 135/24 X |
| 5,088,511 | 2/1992 | Chou et al. | 135/28 X |
| 5,174,319 | 12/1992 | Chou et al. | 135/24 X |
| 5,178,174 | 1/1993 | Wu | 135/24 X |
| 5,232,004 | 8/1993 | Wu | 135/28 X |
| 5,564,449 | 10/1996 | Lin et al. | 135/28 X |
| 5,617,889 | 4/1997 | Wu | 135/24 X |
| 5,626,160 | 5/1997 | Ko | 135/22 |

*Primary Examiner*—Lanna Mai
*Attorney, Agent, or Firm*—Harrison & Egbert

[57] ABSTRACT

An umbrella frame is composed of a shaft, a movable seat, and a locating tube. The movable seat is movably fitted over the shaft and provided at the lower end thereof with a retaining slot engageable and disengageable with a retaining hook located at the lower segment of the shaft. The movable seat is fastened at the top end thereof with one end of a plurality of strut ribs. The locating tube is fastened at the top end thereof with a plurality of ribs which are supported by the strut ribs. The locating tube is further provided in the midsegment thereof with a opening, two lugs, and a pulley mounted pivotally between the two lugs. A cord extends through the pulley such that one end of the cord is fastened with the movable seat, and that another end of the cord is fastened with the bottom end of the shaft. As the retaining hook is actuated by a press button of the shaft, the retaining hook becomes disengaged with the retaining slot of the movable seat so as to enable the cord to pull the movable seat upwards to unfold the umbrella frame.

2 Claims, 6 Drawing Sheets

UMBRELLA FRAME CAPABLE OF AUTOMATIC FOLDING AND UNFOLDING

FIELD OF THE INVENTION

The present invention relates generally to an umbrella frame to the umbrella frame provided with means enabling the umbrella frame to fold and unfold automatically.

BACKGROUND OF THE INVENTION

As shown in FIGS. 1 and 2, a prior art umbrella frame 11 is supported by a shaft 12 which is provided at the top end thereof with a locating cap 13 fastened therewith. The frame 11 comprises a plurality of ribs 14 which are fastened pivotally at the inner ends thereof with a movable rib holder 15 capable of moving up and down along the shaft 12. The ribs 14 are further braced by a plurality of linking ribs 16, which are fastened pivotally at the lower ends thereof with a driving seat 17 capable of moving along the shaft 12. The shaft 12 is fitted into a coil spring 18 located between the rib holder 15 and the driving seat 17 which is provided at the lower segment thereof with a retaining slot 19 engageable with a retaining hook 21. The retaining hook 21 is actuated by a press button 20.

As illustrated in FIG. 3, when the retaining hook 21 is triggered by the press button 20 to release the driving seat 17 from the retaining slot 19, the force is transmitted to the ribs 14 via the linking ribs 16 so as to unfold the frame 11 automatically.

Such a prior art umbrella frame described above is rather complicated in construction and is therefore not cost-effective.

SUMMARY OF THE INVENTION

The primary objective of the present invention is therefore to provide an improved umbrella frame free from the shortcomings of the prior art umbrella frame described above.

In keeping with the principle of the present invention, the foregoing objective of the present invention is attained by an umbrella frame, which includes a shaft, a locating cap for locating the ribs, and a movable seat capable of moving along the shaft. The strut ribs are held by the movable seat. A pulley is fastened with a locating tube such that a cord is run through the pulley. The cord is fastened at one end thereof with the movable seat and at another end thereof with the bottom end of the shaft.

The foregoing objective, features and functions of the present invention will be more readily understood upon a thoughtful deliberation of the following detailed description of an embodiment of the present invention in conjunction with the accompanying drawings.

DETAILED DESCRIPTION OF THE EMBODIMENT

Figure 1:
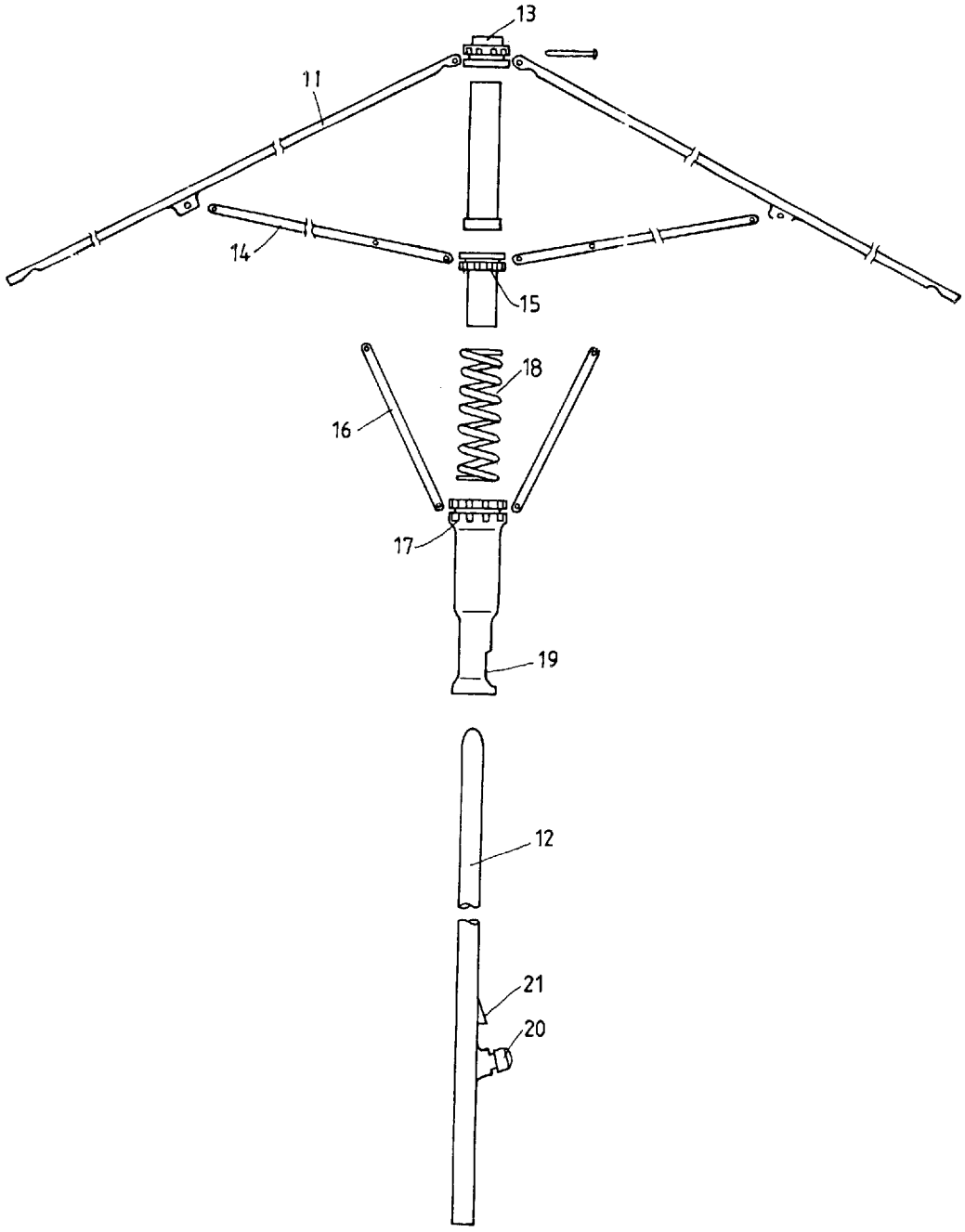
FIG.1 PRIOR ART
FIG. 1 shows an exploded view of an umbrella frame of the prior art.
Figure 2:
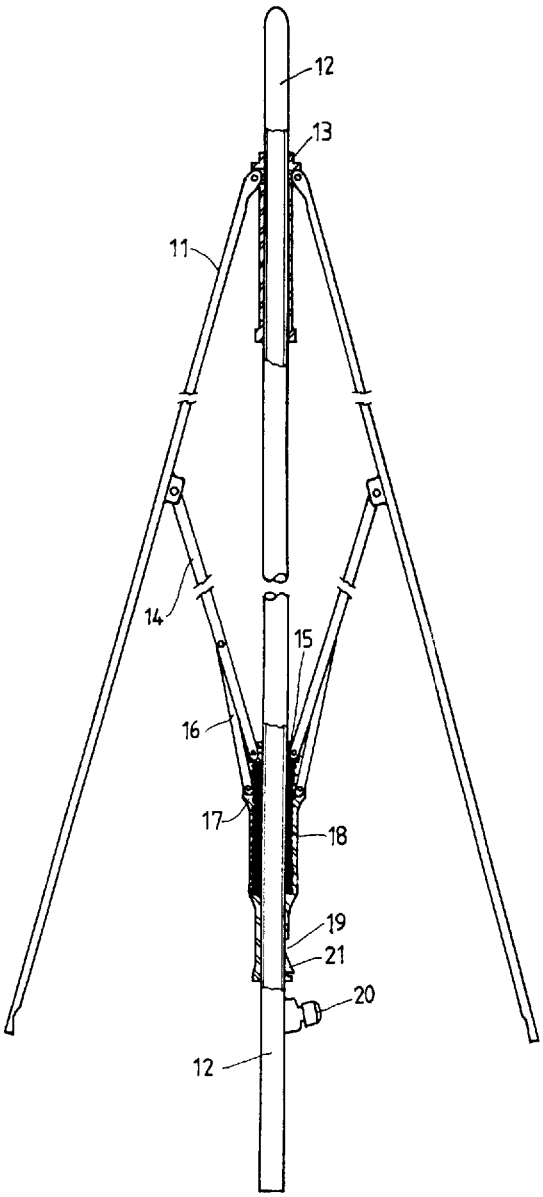
FIG. 2 PRIOR ART
FIG. 2 shows a longitudinal sectional view of the umbrella frame of the prior art.
Figure 3:
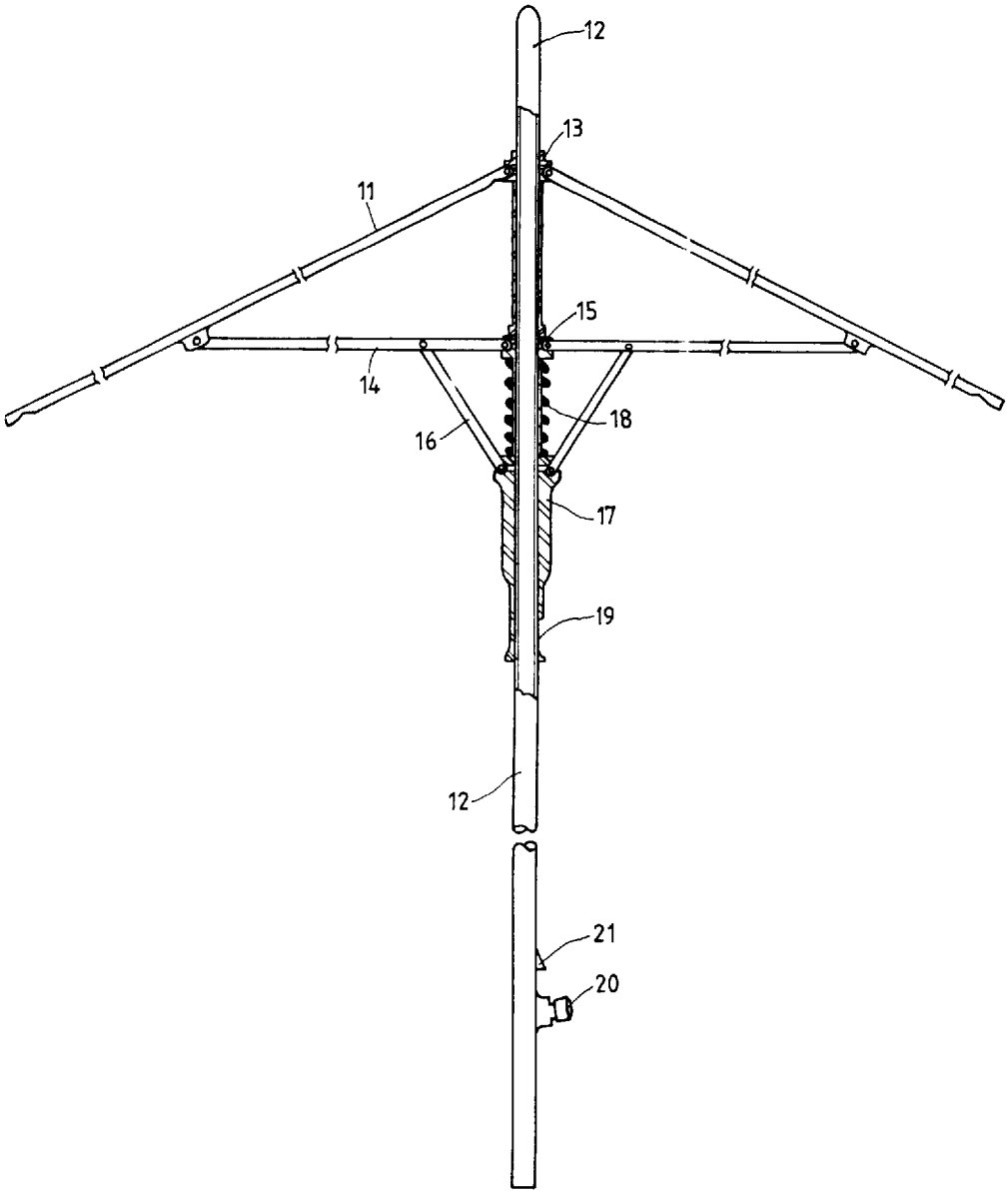
FIG.3 PRIOR ART
FIG. 3 shows a schematic view of the prior art umbrella frame in use.
Figure 4:
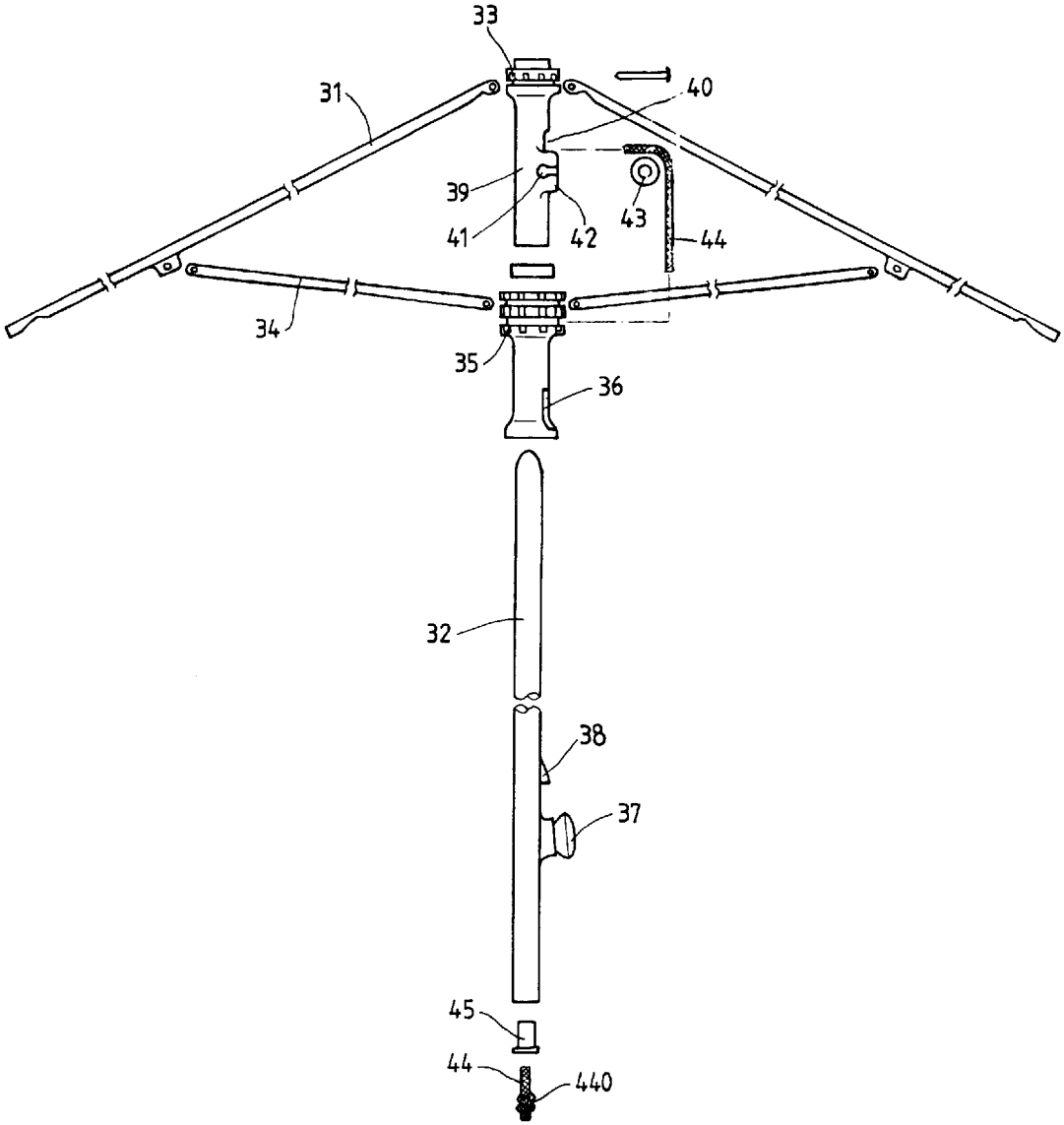
FIG. 4 shows an exploded view of an umbrella frame of the present invention.
Figure 5:
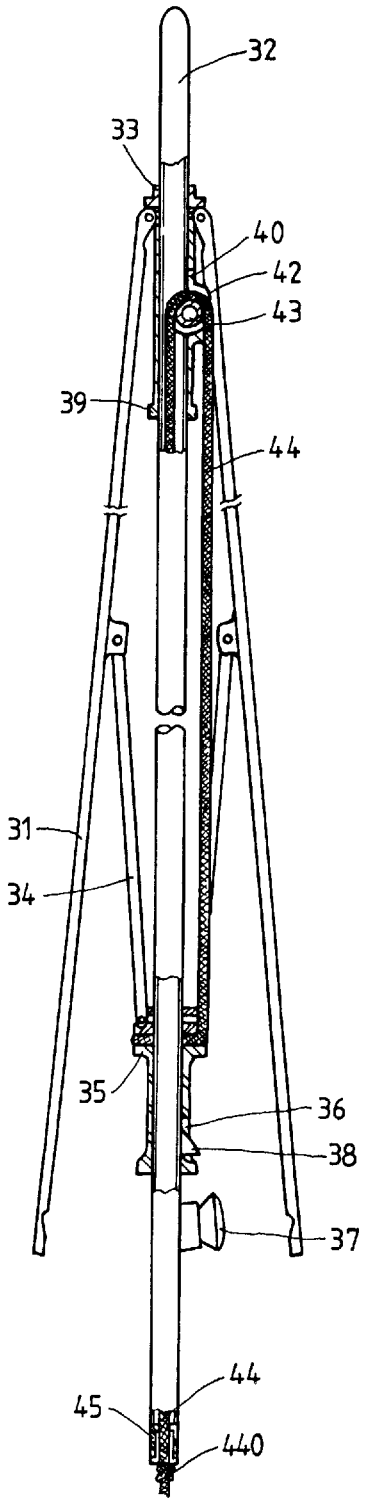
FIG. 5 shows a longitudinal sectional view of the umbrella frame of the present invention in combination.
Figure 6:
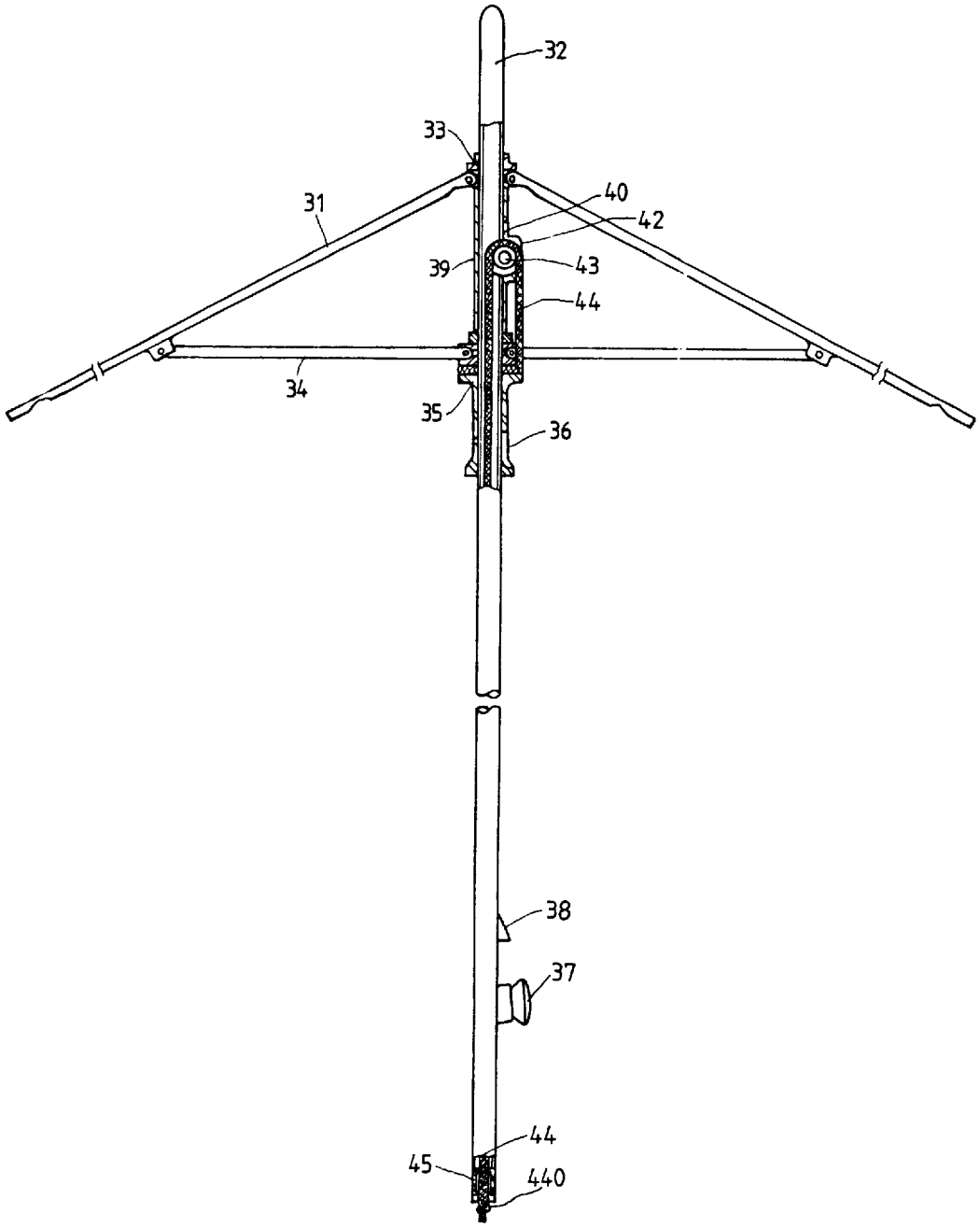
FIG. 6 shows a schematic view of the umbrella frame of the present invention in use.

As shown in FIGS. 4–6, an umbrella frame in accordance with the present invention is mainly composed of a shaft 32, a locating cap 33, and a movable seat 35.

The locating cap 33 is fastened at the top of the shaft 32 and is intended to locate a plurality of ribs 31, which are supported by a plurality of strut ribs 34 which are in turn fastened respectively at one end thereof with the movable seat 35 capable of moving along the shaft 32.

The locating cap 33 is made integrally with a locating tube 39, which is provided with an opening 40 and two lugs 42 each having a pivoting hole 41. Fastened pivotally between the two lugs 42 is a pulley 43 which is in fact mounted rotatably on a pivot received in the pivoting holes 41 of the lugs 42. A cord 44 is run through the pulley 43 such that one end of the cord 44 is fastened with the movable seat 35, and that another end of the cord 44 is put through the opening 40 before being fastened with a retaining body 440 of an arresting member 45 which is located at the bottom end of the shaft 32.

The shaft 32 is provided at the bottom segment thereof with a press button 37 and a retaining hook 38 capable of being actuated by the press button 37 to engage the retaining slot 36 of the movable seat 35 at such time when the umbrella frame of the present invention is folded, as illustrated in FIG. 5. On the other hand, the retaining hook 38 can be actuated by the press button 37 to become disengaged with the retaining slot 36 of the removable seat 35, so as to enable the cord 44 to pull the movable seat 35 upwards along the shaft 32. As a result of the upward movement of the movable seat 35 and the strut ribs 34, the ribs 31 are unfolded, as shown in FIG. 6. The upward movement of the movable seat 35 is terminated at the bottom edge of the locating tube 39. It must be noted here that cord 44 is located in the hollow interior of the shaft 32 via the opening 40 of the locating tube 39.

The umbrella frame of the present invention is relatively simple in construction. For example, the movable rib holder 15 and the driving seat 17 of the umbrella frame of the prior art are replaced by the movable seat 35 of the present invention. In addition, the present invention has eliminated the linking ribs 16 of the umbrella frame of the prior art. The present invention makes use of the cord 44 in place of the coil spring 18 which is relatively heavier than the cord 44. The umbrella frame of the present invention is thus more cost-effective than the prior art.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An umbrella frame comprising:

a shaft of a length and provided at a bottom segment thereof with a press button and a retaining hook being actuated by said press button;

a movable seat of a tubular construction and fitted movably over said shaft, said movable seat fastened at an upper end thereof with one end of a plurality of strut ribs and provided at a lower end thereof with a retaining slot engageable and disengageable with said retaining hook of said shaft; and a locating tube fitted over said shaft and provided at a top end thereof with a locating cap fastened therewith for locating a plurality of ribs which are supported by said strut ribs, said locating tube further provided in a midsegment thereof with an opening, two lugs each having a pivoting hole, a pulley mounted on a pivot which is received in said pivoting hole of said lugs, and a cord running through said pulley such that one end of said cord is fastened with said movable seat and that another end of said cord is fastened with a bottom end of said shaft via said opening of said locating tube and a hollow interior of said shaft, and further that said cord is pulling said movable seat to move upwards along said shaft at such time when said retaining hook is actuated by said press button to become disengaged with said retaining slot of of said movable seat.

2. The umbrella frame as defined in claim 1, wherein said bottom end of said shaft is provided with an arresting member having a retaining body; and wherein said another end of said cord is fastened with said retaining body of said arresting member.

* * * * *